United States Patent [19]

Jay

[11] 3,958,517

[45] May 25, 1976

[54] TABLE

[76] Inventor: Walter M. Jay, 16 Tweed Road, Fox Lake, Ill. 60020

[22] Filed: May 14, 1975

[21] Appl. No.: 577,231

[52] U.S. Cl. ..... 108/159; 248/188

[51] Int. Cl.[2] ..... A47B 3/06

[58] Field of Search ..... 108/111, 157–159, 108/161; 211/148; 248/188

[56] References Cited

UNITED STATES PATENTS

| | | | |
|---|---|---|---|
| 3,623,435 | 11/1971 | Ferdinand et al. | 108/111 |
| 3,877,396 | 4/1975 | Patterson | 108/111 |

*Primary Examiner*—James C. Mitchell

*Attorney, Agent, or Firm*—Vincent L. Carney

[57] ABSTRACT

Each of the four corners of the tempered glass plate in a chrome and glass table rests within a different one of the tubular legs of the table with its apex being centered in the leg and its sides abutting vertical sides of a recessed notch in the tubular wall of the leg, each corner being held in place by a different glass-plate retainer which engages a corresponding tubular leg substantially around its entire circumference and abuts the top of the glass plate. In an embodiment of table having horizontal chrome rims extending between legs of the table and supporting the sides of the plate along its center portion, the glass-plate retainer has a shroud extending downwardly and around the outer joints between the rims and the leg to cover unsightly construction features and has an upper portion elevated above the shroud to engage the top of the glass plate. In another embodiment, the glass-plate retainer has an inner surface which engages the inner surface of the leg across its entire circumference, but receives the glass plate in a recess positioned even with the recessed portion in the leg. The glass-plate retainers are decorative.

16 Claims, 11 Drawing Figures

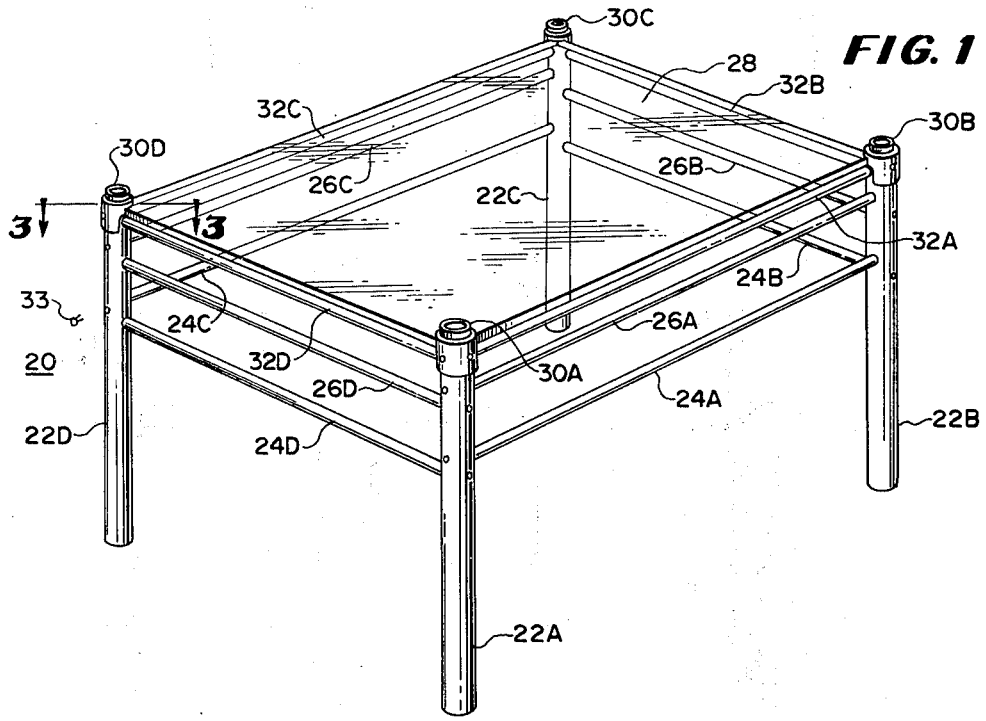
FIG. 1
FIG. 2
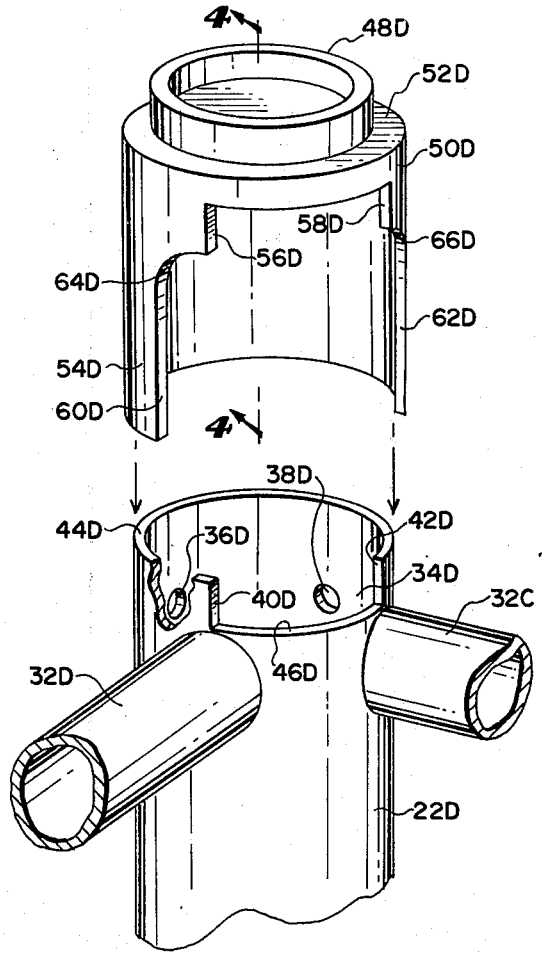
FIG. 3
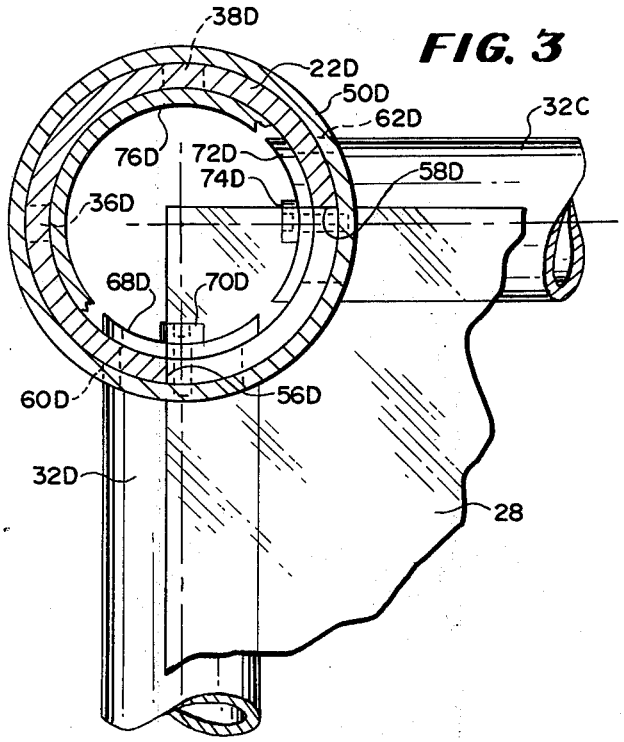

TABLE

This invention relates to tables and has special application to small decorative tables used as pedestals or stands.

In one class of small decorative table, a plate of tempered glass plate is supported by chrome legs, with the corners of the tempered glass plate being received within notches in the legs. In a prior art type of decorative table of this class, a retaining plug fits into the leg and is held therein by retaining springs on the side of the plug.

This prior art type of table has several disadvantages, such as: (1) the glass-plate retainer is not held firmly within the leg since it has a limited gripping surface on the side of the leg; and (2) in the types of leg tables having horizontal chrome rims that support the sides of the glass plate extending between legs, constructional features such as holes for screws that hold the supporting rims and the joints between the rims and the legs are exposed.

Accordingly, it is an object of the invention to provide a novel table.

It is a further object of the invention to provide a relatively inexpensive, decorative table.

It is a further object of the invention to provide a novel table to the type generally designated as chrome and glass tables in which each corner of the glass plate is received in a notch of a different leg of the table and retained in place by a glass-plate retainer.

It is a still further object of the invention to provide a novel glass and chrome table in which the contructional features at the joints of the supporting rims for the glass plate and the leg are hidden by a decorative glass-plate retainer.

It is a still further object of the invention to provide novel glass-plate retainers for mounting a glass plate to the chrome legs of a table.

It is a still further object of the invention to provide a novel and inexpensive decorative glass-plate retainer which grips the legs of the table firmly about substantially their entire circumference.

It is a still further object of the invention to provide a novel glass-plate retainer for mounting glass plates to the chrome legs of tables, which glass-plate retainer is decorative and hides unsightly constructional details of the legs of the glass and chrome table.

In accordance with the above and further objects of the invention, a glass and chrome table includes a tempered glass top and chrome legs, with each corner of the glass top being supported by a different one of the chrome-plated legs. To support the glass plate, the chrome-plated legs each have a recess which receives a corner and supports it and a glassplate retainer that fits over the glass plate to hold it thereto.

The glass-plate retainers are decorative and frictionally grip the legs along the entire circumference, and in some embodiments, on both sides of the walls of the chrome plate. In one embodiment, the glass-plate retainers include a slotted portion which is aligned with the notch in the leg and receives the corner of the glass plate, gripping the circumference of the leg beneath the notch and around its entire internal wall.

In embodiments of tables having horizontal chrome rims extending between the legs and supporting the glass plate, the glass-plate retainer includes a shroud extending over the leg and hiding construction details related to the joints between the rims and the legs, with the shroud extending in a curved fashion around the outer edges of the legs and up over the glass plate, which it retains. In this embodiment, the legs may be gripped frictionally on the outside by the shroud and on the inside by an inner surface of the glass-plate retainer.

As can be understood from the above summary, the table of this invention has the advantages of: (1) being decorative; (2) being inexpensively fabricated and assembled; (3) including glass-plate retainers that hold the glass plate firmly in place with a strong frictional grip with the legs of the table; and (4) being able to hide the constructional details of the joints between horizontal chrome rims and the legs of the table.

The above noted and other features of the invention will be better understood from the following detailed description when considered with reference to the accompanying drawings in which:

FIG. 1 is a perspective view of a glass and chrome table including an embodiment of the invention;

FIG. 2 is a fragmentary, exploded perspective view of one leg of the table of FIG. 1 in accordance with an embodiment of the invention;

FIG. 3 is a sectional view taken through lines 3—3 of FIG. 1;

Figure 4:
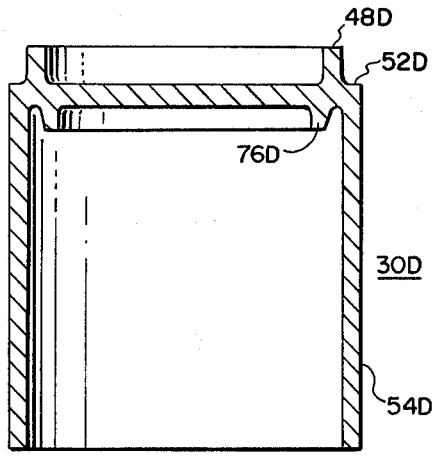
FIG. 4 is a sectional view taken through lines 4—4 of FIG. 2.

In FIG. 1, there is shown a perspective view of a tempered-glass chrome table or stand 20 having four tubular chrome upstanding legs 22A–22D, four lower chrome leg braces 24A–24D, four upper chrome leg braces 26A–26D, a top glass plate 28, and four tubular chrome support rims 32A–32D for the top glass plate 28.

The four vertically-upstanding legs 22A–22D are connected together by the upper and lower horizontal leg braces 24A–24D and 26A–26D and by the horizontal support rims 32A–32D, with the top plate of tempered glass 28 resting upon the horizontal support rims 32A–32D and being held in proper alignment within recesses in the four legs 22A–22D. The four glass-plate retainers 30A–30D retains the glass plate in place, covers certain unsightly constructional features of the legs 22A–22D and provides a decorative design effect.

In the preferred embodiment, the legs 22A–22D, the horizontal leg braces 24A–24D and 26A–26D and the horizontal support rims 32A–32D are cylindrical tubes of steel with chrome plating, with the leg braces 24 and 26 being mounted to the legs 22 in the manner described in copending application Ser. No. 434,235, filed Jan. 17, 1974 by Walter M. Jay for TABLE now U.S. Pat. No. 3,910,206. However, materials other than chrome-plated steel may be used and other shapes of tubes may be used without deviating from the main principles of the invention. Moreover, plastic, steel plate, wood, composition or other materials may in some instances be substituted for the tempered-glass plate 28 and the glass-plate retainers 30A–30D may be of several different ornamental designs and materials. While a relatively small table is shown in FIG. 1, the invention may be applied to larger tables or other pedestal-type structure utilizing upstanding legs and a flat-supporting top.

While in FIG. 1 a table is shown having horizontal leg braces 24A–24D and 26A–26D, small tables do not require such braces and may be supported by the support rims 32A–32D. Larger tables, however, do require at least one leg brace. Accordingly, the leg braces may be omitted in smaller tables and fewer leg braces may be used in some tables. In FIG. 1 the legs 22 have openings for fastening the leg braces to each other. It is possible to fabricate tables with braces and rims without such openings either by fastening the rims or braces from the open top of the leg as it is being assembled or by closing the hole with a chrome plug such as that shown at 33. Such chrome plugs may have a surface which is adapted to have a decorative effect with the leg or may be shaped to conform to the curvature of the leg so as to be inconspicuous. The plugs may be fastened by any suitable means such as by projecting spring legs that are inserted into the hole and biased against the edges to hold the decorative buttons over the hole or which may be fastened to the inner wall of the leg for those buttons which are to conform to the curvature of the leg.

Generally, a small end table only having the rim supports and not the stretcher supports would be approximately 20 inches by 28 inches by 21 inches and might serve as an end table or a cocktail table. A larger table such as a dining table with one or more stretchers or braces between each pair of legs would be substantially 36 inches by 60 inches by 29 inches. These dimensions are width, length and height, in that order. A cocktail table would be 15 inches high whereas an end table would be approximately 21 inches high. A corner cocktail table would be 30 inches by 30 inches by 15 inches.

As best shown in FIG. 2, the top of the vertical leg 22D includes a notch or recess 34D and two screw holes 36D and 38D, with the notch 34D having two vertical walls 40D and 42D extending downwardly from the upper rim or edge 44D and connecting at right angles the curved horizontal recessed edge portion 46D within the wall of the leg 22D. The sides 40D and 42D are spaced 90° apart along the circumference of the cylindrical wall of the leg 22D.

To support the glass plate 28 at a first of its four corners and along the sides adjacent to the first corner, the upper surface of the horizontal support rims 32D and 32C are aligned with the bottom recessed edge 46D and the vertical sides 40D and 42D are each aligned with the longitudinal axis of a respective one of the rims 32D and 32C. As shown in FIG. 1, the glass plate 28 fits within the recess 34D, the first corner of the glass plate being supported thereon with the edge of the glass plate between the first corner and a second corner being supported upon the top edge along the center of the horizontal support rim 32D and another edge of the glass plate between the first corner and a third corner being supported along the uppermost portion of the horizontal support rim 32C.

The sides of the glass plate adjacent to the first corner abut the vertical sides 40D and 42D of the notch 34D and its apex extends to the center of the leg 22D since the vertical sides 40D and 42D are spaced 90° apart. The screw holes 36D and 38D are each aligned with the horizontal axis of a respective one of the horizontal support rims 32C and 32D to accommodate screws for fastening these horizontal support rims in place.

To hold the glass plate to the leg 22D and to improve the appearance of the table, the glass-plate retainer 30D includes a decorative top 48D, connected to a tubular-holding portion 50D by a shoulder 52D, with the shoulder 52D having a horizontal annular surface which may accommodate the bottom rim of a table leg if desired and a vertical cylindrical rim which may fit inside the table leg. The tubular-holding portion 50D is cylindrical and has: (1) an inner wall slightly larger than the outer wall of the leg 22 so as to fit tightly thereover; and (2) a depth which is less than the height of the vertical walls 40D and 42D by the width of the plate of glass 28 so as to hold a plate of glass 28 against the recessed edge 46D when positioned over the leg 22D.

To cover screw holes 36D and 38D and the connections between the horizontal support rims 32 and the leg 22D, the glass-plate retainer 30D includes a shroud 54D extending downwardly from the tubular-holding portion 50D and, in the preferred embodiment, having inner and outer walls conforming in curvature to the inner and outer walls of the holding portion 50D. The shroud 54D may extend to any depth sufficient to cover the holes 36D and 38D and may have a decorative outer surface and bottom edge if desired.

The shroud 54D includes two upper vertical shoulders 56D and 58D and two lower vertical edges 60D and 62D connected by curved portions 64D and 66D. The edges 56D and 58D are spaced from each other by 90° so as to be aligned with the vertical side 40D and 42D of the leg 22D whereby they fit along side of the glass plate 28 when it is in place, permitting the edge of the holding portion 50D to compress the top surface of the plate 28 against the horizontal supporting rims 32D and 32C. The curved portions 64D and 66D have a curvature which conforms to the curvature of the horizontal supporting rims 32D and 32C so as to fit thereagainst and cover the connecting portions between the supporting rims and the leg 22D, extending below these supporting rims to a length determined by the vertical sides 60D and 62D.

As best shown in FIG. 3, the horizontal supporting rim 32D is mounted to the leg 22D by a washer 68D and a screw 70D and the horizontal supporting rim 32C is mounted to the leg 22D by a curved washer 72D and a screw 74D, with the screws 70D and 74D passing through the washers 68D and 72D respectively and being threaded into radial apertures in the leg 22D and into closed ends or blocking portions of the horizontal supporting rims 32D and 32C respectively. An inner tube or skirt 76D (shown broken-away in FIG. 3 to provide a better illustration of the washers 68D and 72D) fits inside the leg 22D to increase the frictional holding power of the glass-plate retainer 30D and extends downwardly to a depth just above the tubular-holding portion 50D.

The inner skirt 76D slopes away from the shroud to provide a larger opening at its bottom, thus permitting easier molding and better reception of the wall of the table leg. The wall of the table leg is gripped firmly between the wall of the shroud and the skirt near the upper edge of the leg wall where the skirt and shroud are closest together. To obtain even better gripping action between the glass-plate retainer and the leg of a table, a spring clip (not shown) may be mounted to the retainer with spring biased prongs spread to engage the inner walls of the leg at spaced apart locations. Of course, such a clip may also be mounted to the leg to grip the inside of the retainer. Generally, however, a spring clip is not necessary since the friction between the wall of the leg and the retainer between the shroud and skirt of the retainer is sufficient.

With this arrangement, the glass plate 28 rests upon the horizontal edge 46D with its sides abutting the vertical sides 40D and 42D within the notch 34D and being aligned with the longitudinal axes of the horizontal supporting rims 32D and 32C upon which they rest. The glass-plate retainer 30D fits over the leg, with its tubular-holding portion 50D abutting the top of the plate 28 to hold it in place and its shroud passing around the connecting portions of the horizontal supporting rims 32D and 32C on their outer side to hide their connecting structure while extending downwardly to cover the holes 36D and 38D which are used, in the preferred embodiment, to tighten the screws 70D and 74D.

Of course the supporting rims 32D and 32C may have different shapes and may be fastened by any suitable means other than that described. For example, they may be notched and pass over each other with their notches engaging within the leg 22D and their ends held to the outer wall by screws or bolts passing through the holes 36D and 38D. Moreover, the plate 28 may be supported within the leg or by surfaces other than the horizontal surface 46D. However, the glass-plate retainer 30D should in each instance provide a decorative effect, hold the glass plate 28 in place and cover unsightly constructional features of the leg 22D and the horizontal supporting rims 32D and 32C.

While a glass-plate retainer 30D and a leg 22D with its connecting horizontal supporting rims 32D and 32C are described in some detail without describing the remaining retainers and legs of the table 20, it can be easily understood by analogy that each of the legs is connected in a similar manner to horizontal-supporting rims to support the glass plate. Moreover, a different number of legs may be used in other tables with different shapes of glass plate by changing the angles within the legs and the angles of the plates and, instead of notches in the top edge of the legs, notches may be cut along other portions of the leg to support several stacked glass plates.

Although the slots 34D face slots in another retainer diagonally across the rectangular glass plate 28 and table as shown in FIG. 1, they will, of course, face in other directions with different configurations of glass plate and table. Similarly, in some embodiments, it is possible to omit the horizontal supporting rims and support the glass on the corners of the legs 22.

In FIG. 4, there is shown a sectional view of the glass-plate retainer 30D taken through line 4—4 of FIG. 2. As best shown in this drawing, the inner cylindrical tube 76 or skirt extends downwardly from the inner surface of the glass-plate retainer 30D a distance slightly less than the distance of the tubular-holding portion 50D so as to permit the holding portion 50D to contact the glass plate 28 (FIGS. 1 and 3) when the glass-plate retainer 30D is in place.

The tube 76D is spaced from the shroud 54D and holding portion 50D a distance slightly larger than the thickness of the wall of the leg 22D so that the top portion of the leg 22D fits between the tube 76D and the shroud 54D over one portion and the tube 76D and the holding portion 50D over another portion, thus providing a strong frictional grip between the leg 22D and the glass-plate retainer 30D, with the top edge 44D of the leg 22D fitting adjacent to the top of the glass-plate retainer 30D. However, the tube 76D may be omitted if it is not desirable to have firm retaining, in which case the shroud 54D and top holding portion 50D grip the wall of the leg 22D across its outer surface to retain the glass plate 28.

Figure 5:
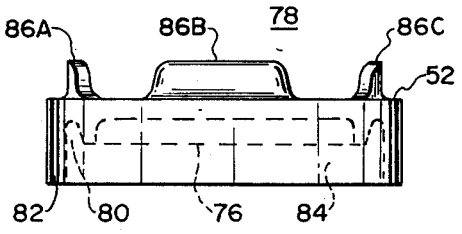
FIG. 5 is a front elevational view of a glass-plate retainer in accordance with another embodiment of the invention.
Figure 6:
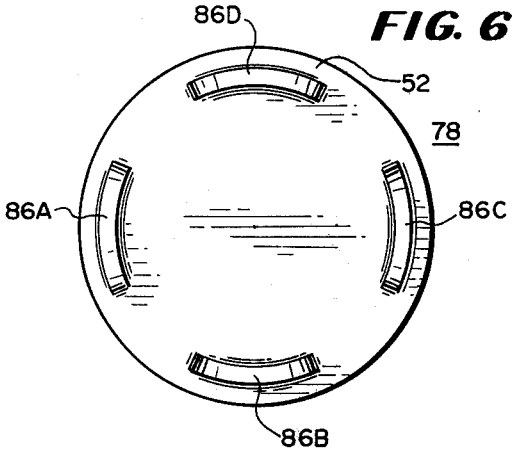
FIG. 6 is a plan view of the glass-plate retainer of FIG. 5.
Figure 7:
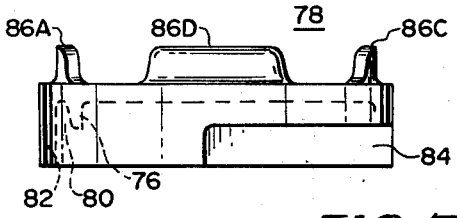
FIG. 7 is a side elevational view of the glass-plate retainer of FIG. 5.

In FIGS. 5, 6 and 7 another embodiment of glass-plate retainer 78 is shown having certain parts identical to parts in the embodiment of FIGS. 2-4, which identical parts have the same reference numbers and certain different parts. This embodiment: (1) does not have a shroud similar to the shroud 50D; (2) has a decorative projection different from 48D shown in FIG. 2; and (3) has an inner tubular wall similar to 76D in FIGS. 3 and 4 which forms one side of a retaining groove 80.

Instead of a shroud, the glass-plate retainer 78 has a cylindrical tubular-holding portion 82 extending around the glass-plate retainer except for the 90° cutaway portion 84 which accommodates glass plate 28 in the same manner as in the embodiment of FIG. 2. The top portion of this embodiment includes four separated curved projections 86A–86D positioned as a partial cylinder able to accommodate the bottom of a leg 22 and forming a decorative crown-like design inside the shoulder 52 which serves the same function as the corresponding shoulder 52 in the embodiment of FIG. 2.

The glass-plate retainer 78 performs the same function in substantially the same manner as the glass-plate retainer 30D except its shroud does not extend down on one side so as to provide limited coverage of the connections with the horizontal supporting rims such as 32 shown in the embodiment of FIGS. 2 through 4. It is especially suitable for embodiments of tables which do not have such supporting rims and in which the glass plate is supported only by the legs 22 of the table.

Figure 8:
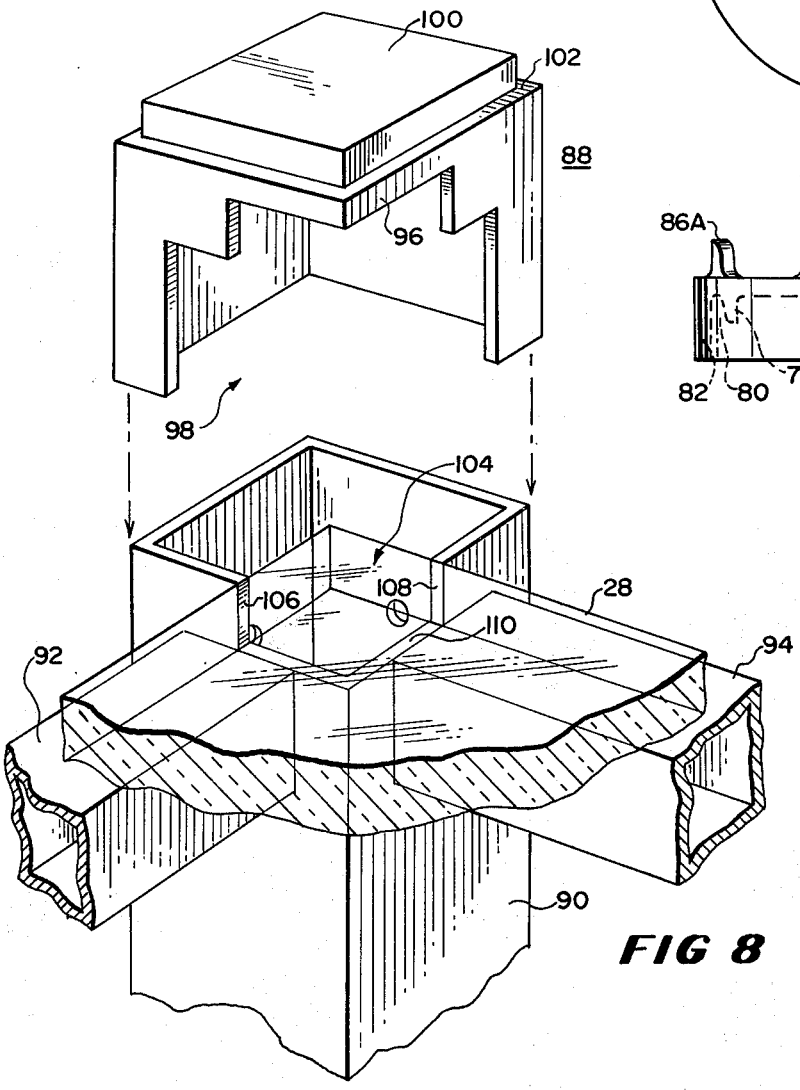
FIG. 8 is a fragmentary, exploded perspective view of another embodiment of a table leg in accordance with another embodiment of the invention.

In FIG. 8, there is shown another embodiment of glassplate retainer 88 designed to cooperate with a table leg 90 having a substantially rectangular or square cross section. Two horizontal supporting rims 92 and 94 also having substantially square or rectangular cross sections are received by and fastened to the leg 90 in a manner analogous to the supporting rims 32 and legs 22 of the embodiments of FIGS. 1 through 7.

To form a frictional fit over the leg 90 and retain the glass plate 28, the glass-plate retainer 88 includes a substantially square or rectangular holding portion 96 extending downwardly and having an open bottom, with a cutaway portion 98 being positioned to accommodate a plate of glass 28. On the top surface of the glass-plate retainer 88, is a decorative rectangular projection 100 which is centered and surrounded by a rectangular shoulder 102 adapted to receive a rectangular opening in a leg.

The cutaway portion 98 has a top surface forming a right angle conforming to the corner of a wall of the leg 90 and subtending a 90° arc to receive a glass plate having its center in the center of the leg 90. The inner surface of the walls of the holding portion 96 is of the correct size and shape to form a frictional fit with the outer surface of the wall 90 and may include an inner rectangular wall to grip the inner surface of the wall of the leg 90 if desired.

To receive and support a glass plate, the leg 90 includes a rectangular or square cross section having a corner 104 recessed with vertical sides 106 and 108 and a horizontal right angle wall portion 110 of a sufficient angle to subtend 90° so as to receive a corner of a glass plate with the corner of the glass palte extending to the center of the leg 90. The vertical sides 106 and 108 are aligned with the longitudinal axis of and orthogonal to the center line of the horizontal flat surface of the supporting rims 92 and 94, which supporting rims are horizontal and substantially level with the surface 110 so that a plate of glass has its upporting edges aligned with the centers of the top surface of the rims 92 and 94 and its corner supported by the surface 110 and abutting the vertical surfaces 106 and 108, the holding portion 96 engaging the glass in the cutaway portion 98 and holding it in place.

As can be readily understood, the embodiment of FIG. 8 functions in the same manner as the embodiments of FIGS. 1 through 7 but is especially designed to accommodate tables having rectangular or square legs. If desired, round supporting rims and stretchers or braces may be used with the square legs instead of square rims and braces.

Figure 9:
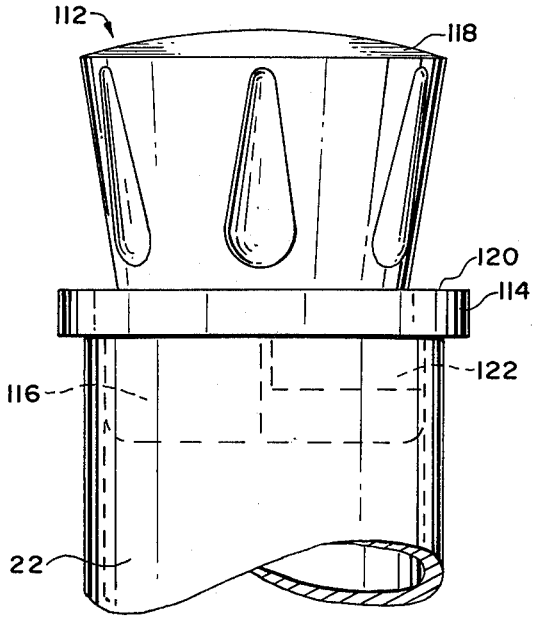
FIG. 9 is a fragmentary, elevational view of a leg of a table in accordance with still another embodiment of the invention.
Figure 10:
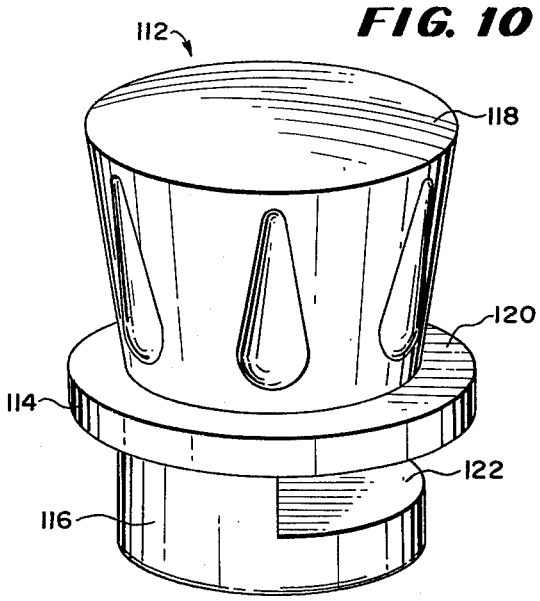
FIG. 10 is a perspective view of a glass-plate retainer in accordance with the embodiment of FIG. 9.

In FIGS. 9 and 10, there is shown another embodiment of glass-plate retainer 112 adapted to cooperate with a cylindrical table leg 22 (FIG. 1) but not having an outwardly extending shroud nor holding portion. This embodiment, like the embodiment of FIGS. 5 through 7, is most suitable for use with tables not having horizontal supporting rims although with minor modifications it can be used with such tables as well.

As best shown in FIG. 9, the glass-plate retainer 112 includes three sections having coincident longitudinal axes, which are: (1) a cylindrical cap 114; (2) a cylindrical plug 116 extending downwardly from the cap 114 and having a smaller diameter; and (3) a top cylindrical decorative projection 118 extending upwardly from the cap 114 with a smaller diameter to form a shoulder 120, the shoulder 120 and the cylindrical projection 118 forming a frictional fit to receive the bottom of another cylindrical table leg for a multi-shelf table as described above.

Between the cap 114 and the plug portion 116 is a cutaway pie-shaped portion 122 forming a 90° arc and extending to the longitudinal axis of the plug portion 116 so that the corner of a plate of glass may extend into this section and be supported thereby. The plug section 116 has an outer wall of such a size as to form a friction fit with the inner wall of the top of the leg 22 so that the corner of a plate of glass is supported by the bottom wall of the cutaway section 112 and held to the leg 22 by the friction of the plug section 116. The outer wall of the leg 22 is also cut away at 122 to receive the corner of a plate of glass between its side wall portions.

The cutaway portion in the leg 22 is similar to the cutaway portion in the embodiments of FIGS. 1 through 3 so that its side walls engage the walls of a corner of a glass plate 28 thus forming a decorative connection. This embodiment provides good holding action because the plug 116 grips the inner wall of the leg 22 across an entire 360° surface. Locating ribs and grooves may be formed in the wall of the leg 22 and the plug 116 for the purpose of locating the plug 116 if desired.

Figure 11:
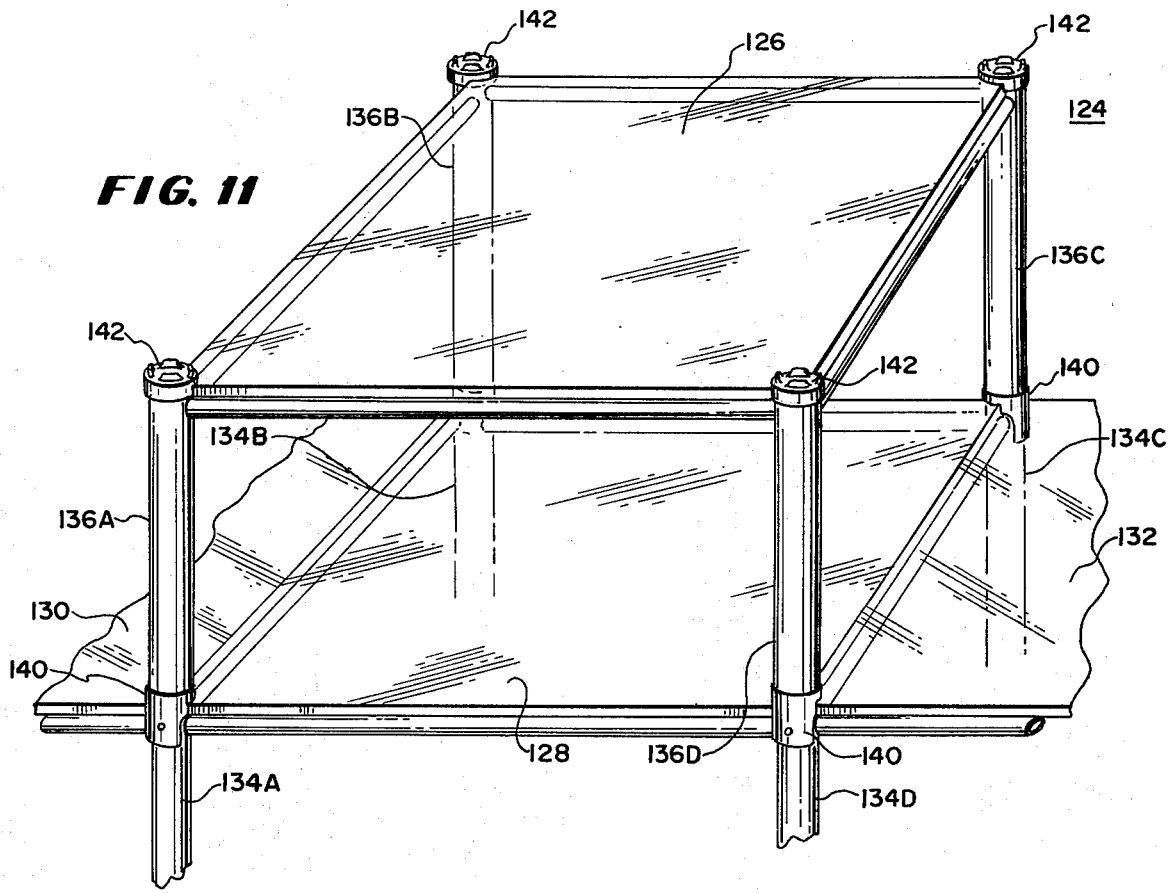
FIG. 11 is a fragmentary, perspective view of still another embodiment of the invention.

In FIG. 11 there is shown a fragmentary perspective view of an embodiment of table 124 having stacked shelves, with a top plate of glass 126, a plate of glass directly below it 128, and lower plates of glass 130 and 132 aligned with the plate of glass 128. Other shelves may be included if desired.

In this embodiment, lower legs 134A–134D include fasteners such as those shown in FIGS. 5 through 7 but having two side-by-side cutaway portions 140 or a single cutaway portion forming 180° rather than 90° so as to receive two side-by-side planes of glass such as 128 and 130. Horizontal supporting ribs are not used in the embodiment of FIG. 11 although they could be included with a slight modification.

The top shelf 126 is supported by legs 136A–136D and held by glass-plate retainers 142 similar to the retainers 78 (FIGS. 5–7) to form a second layer which receives the plate of glass 126. It can be seen with this arrangement that several shelves may be combined with relative ease to form different decorative tables and stands.

The shoulders 52 and 102 on the glass-plate retainers of this invention, are of sufficient thickness so that the leg of a second level may sit thereon tightly against an inner surface where it may be held by screws, leaving an additional shoulder which is the thickness of the bottom wall of a glass-plate retainer. This enables successive layers to be stacked one on top of the other using relatively standard parts although if adjoining shelves are to be held by glass-plate retainers, the cutaway portions will have to accommodate the adjoining shelves and be 180° or positioned on both sides of the retainers where necessary.

To assemble the tables of this invention, horizontal suporting rims such as 32, embodiments having such rims, are fastened to the legs first by inserting screws through washers 68D and 72D (FIG. 3) and threading them into the supporting rims through the apertures 36D and 38D. These apertures will be covered by shrouds of the glass-plate retainers when the table is fully assembled for these embodiments.

After the horizontal supporting rims are assembled in the embodiments having such rims and after the legs and supporting braces have been assembled in other embodiments, the glass plate 28 is inserted into the notch in the top of the leg where it rests against the horizontal surfaces such as 46D shown in FIG. 2 or 3. In embodiments such as those shown in FIGS. 9 and 10, the glass plalte is inserted into the notch 22 instead after the glass-plate retainer is inserted into the leg.

In embodiments in which the glass plate rests upon a surface such as 46D and the leg, the glass-plate retainer is then inserted so as to cover the structural features included in the table to enable easy assembly of horizontal rims or the like and to hold the glass plate in place. When assembled, these glass-plate retainers form a tight frictional grip with the legs so as to hold the glass plate in place.

As can be understood from the above description, the tables of this invention have the advantages of: (1) being highly decorative; (2) being inexpensively fabricated and assembled; (3) including glass-plate retainers that hold the glass plate firmly in place with a strong frictional grip with the legs of the table; and (4) being able to hide the constructional details of the joints between horizontal chrome rims and the legs of the table.

Although an embodiment of the invention has been described with some particularity, many modifications and variations in the invention are possible within the light of the above teachings. It is therefore to be understood that, within the scope of the appended claims, the invention may be practiced other than as specifically described.

What is claimed is:

1. Apparatus for mounting a table top to the table legs of a table, comprising:

table top retaining means having at least one wall portion for engaging at least one portion of the surfaces of the table top so as to restrain its upward movement;

a decorative top portion integrally formed with said table top retaining means and extending upwardly therefrom; and friction means for engaging the wall of a table leg substantially across areas extending through a 360 degree angle about the longitudinal axis of the table leg;

said friction means being integrally formed with said table top retaining means and extending downwardly therefrom.

2. Apparatus according to claim 1 in which said table legs are tubular and include internal walls defining a downwardly extending recess adapted to receive the corner of a table top.

3. Apparatus according to claim 2 in which:

said table top retaining means includes a horizontal first member larger than said table leg and said decorative top portion;

said decorative top portion extending from the top surface of said horizontal member to define a shoulder therearound and having substantially the same size and shape outer periphery adjacent to said top surface as the inner wall of said table leg.

4. Apparatus according to claim 3 in which:

said friction means includes a plug having a cross-section substantially of the size and shape as the cross-section through the inner surface of the wall of said leg whereby said plug fits within said wall of said leg;

said wall portion includes internal walls defining a horizontal notch in said plug positioned to be at least partly aligned with one of said downwardly extending recesses in said table legs, whereby said table top is received in said table legs and horizontal notches.

5. Apparatus according to claim 2 in which:

said table includes rim means intersecting said table leg orthogonally thereto;

said rim means having top surfaces substantially level with the bottom surface of said recessed portion;

said wall portion extends downwardly toward said recess to a distance substantially the thickness of said table top from the bottom of said recess;

said rim means having longitudinal axes intersecting at the center of said table legs.

6. Apparatus according to claim 5 further including:

a plurality of leg braces connecting adjacent ones of said table legs;

said leg braces being tubular and having a smaller outer diameter than said table legs;

said table legs having internal walls defining an aperture into which said leg braces may fit.

7. Apparatus according to claim 6 in which at least one of said rims is fastened to the external wall of said table legs.

8. Apparatus according to claim 7 in which said friction means includes a shroud extending outside said leg to a location lower than said rims and located around said leg at a location opposite to and adjacent to said rims, whereby the joints between said rims and legs are at least partly obscured from view.

9. Apparatus according to claim 3 in which:

said table includes rim means intersecting said table leg orthogonally thereto;

said rim means having top surfaces substantially level with the bottom surface of said recessed portion;

said wall portion extends downwardly toward said recess to a distance substantially the thickness of said table top from the bottom of said recess;

said rim means having longitudinal axes intersecting at the center of said table legs.

10. Apparatus according to claim 9 in which said friction means includes a shroud extending outside said leg to a location lower than said rims and located around said leg at a location opposite to and adjacent to said rims, whereby the joints between said rims and legs are at least partly obscured from view.

11. Apparatus according to claim 1 in which said friction means includes a shroud extending outside said leg to a location lower than said rims and located around said leg at a location opposite to and adjacent to said rims, whereby the joints between said rims and legs are at least partly obscured from view.

12. Apparatus according to claim 3 in which said friction means includes a shroud extending outside said leg to a location lower than said rims and located around said leg at a location opposite to and adjacent to said rims, whereby the joints between said rims and legs are at least partly obscured from view.

13. Apparatus according to claim 1 in which said friction means includes parallel wall portions spaced from each other a distance substantially equal to the thickness of the wall of the legs, whereby the wall of the legs is gripped between the parallel wall portions of the friction means.

14. Apparatus according to claim 2 in which said friction means includes parallel wall portions spaced from each other a distance substantially equal to the thickness of the wall of the legs, whereby the wall of the legs is gripped between the parallel wall portions of the friction means.

15. Apparatus according to claim 4 in which said friction means includes parallel wall portions spaced from each other a distance substantially equal to the thickness of the wall of the legs, whereby the wall of the legs is gripped between the parallel wall portions of the friction means.

16. Apparatus according to claim 8 in which said friction means includes parallel wall portions spaced from each other a distance substantially equal to the thickness of the wall of the legs, whereby the wall of the legs is gripped between the parallel wall portions of the friction means.

* * * * *